US005590801A

United States Patent [19]

Cohen

[11] Patent Number: 5,590,801

[45] Date of Patent: Jan. 7, 1997

[54] LOCKABLE CONTAINER

[76] Inventor: Neil Cohen, 47-09 30th St., LIC, N.Y. 11101

[21] Appl. No.: 991,139

[22] Filed: Dec. 16, 1992

[51] Int. Cl.[6] ..... B65D 45/00

[52] U.S. Cl. ..... 220/315; 220/608; 220/623; 220/675; 220/751; 224/417; 224/435; 224/935; 248/311.2; 70/63; 70/233; 292/307 R; 292/307 B

[58] Field of Search ..... 220/210, 315, 220/608, 623, 669, 671, 675, 751, 480, 481; 224/32 R, 35; 248/230, 311.2; 70/63, 233; 292/307 R, 307 B

[56] References Cited

U.S. PATENT DOCUMENTS

| | | | |
|---|---|---|---|
| 575,536 | 1/1897 | Swanson | 224/35 |
| 596,998 | 1/1898 | Hawkins et al. | 224/35 X |
| 3,251,605 | 5/1966 | Edmonds | 220/675 X |
| 4,079,872 | 3/1978 | Halter | 224/31 |
| 4,256,322 | 3/1981 | Otsuka . | |
| 4,260,084 | 4/1981 | Warren, Jr. . | |
| 4,387,835 | 6/1983 | Gölzer . | |
| 4,577,477 | 3/1986 | Olshausen | 70/233 X |
| 4,809,890 | 3/1989 | Tsigadas | 224/35 X |
| 4,989,741 | 2/1991 | Dull et al. | 220/675 X |
| 5,024,358 | 6/1991 | Reichert et al. | 224/35 |
| 5,169,023 | 12/1992 | Heiberg et al. | 220/574 |

*Primary Examiner*—Allan N. Shoap
*Assistant Examiner*—Stephen Cronin
*Attorney, Agent, or Firm*—Saidman Designlaw Group

[57] ABSTRACT

A lockable container is disclosed in combination with a U-shaped bicycle lock. The lock has a rigid U-shaped portion in which the open end is spanned by a rigid locking bar. The container comprises a body and a cap, both with channels thereon, which receive the parallel arms of the U-shaped portion and the locking bar therein. When the lock is locked, the cap cannot be removed from the container, so articles left therein are safe. A space between the bight of the U-shaped portion and the bottom of the container can be used to securely attach the combination to a suitably shaped permanent fixture.

1 Claim, 2 Drawing Sheets

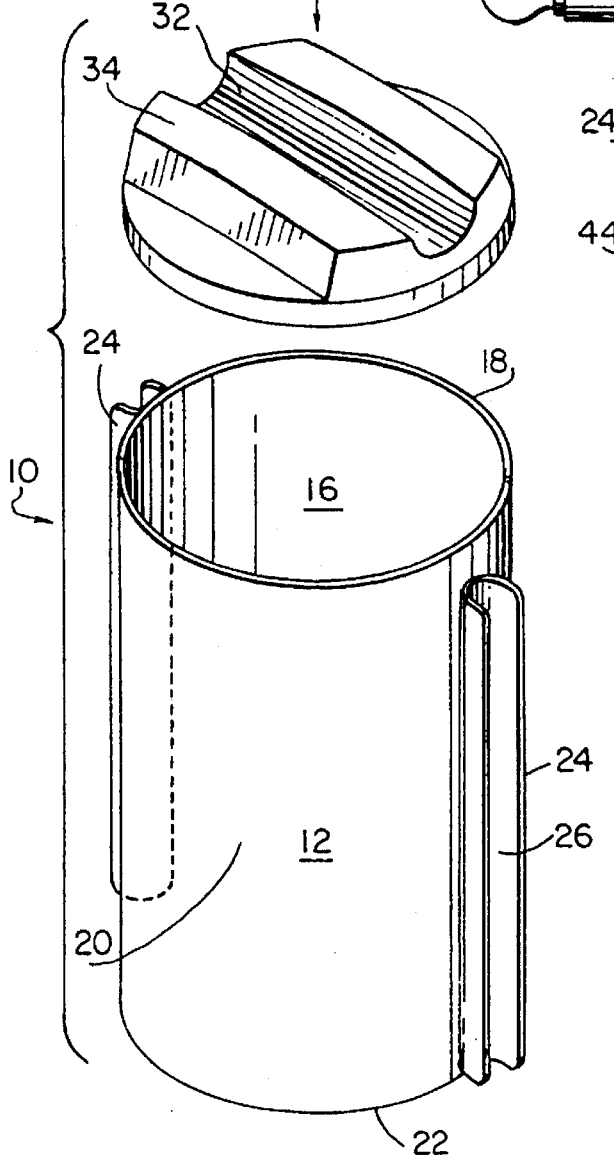
FIG.1
FIG.2
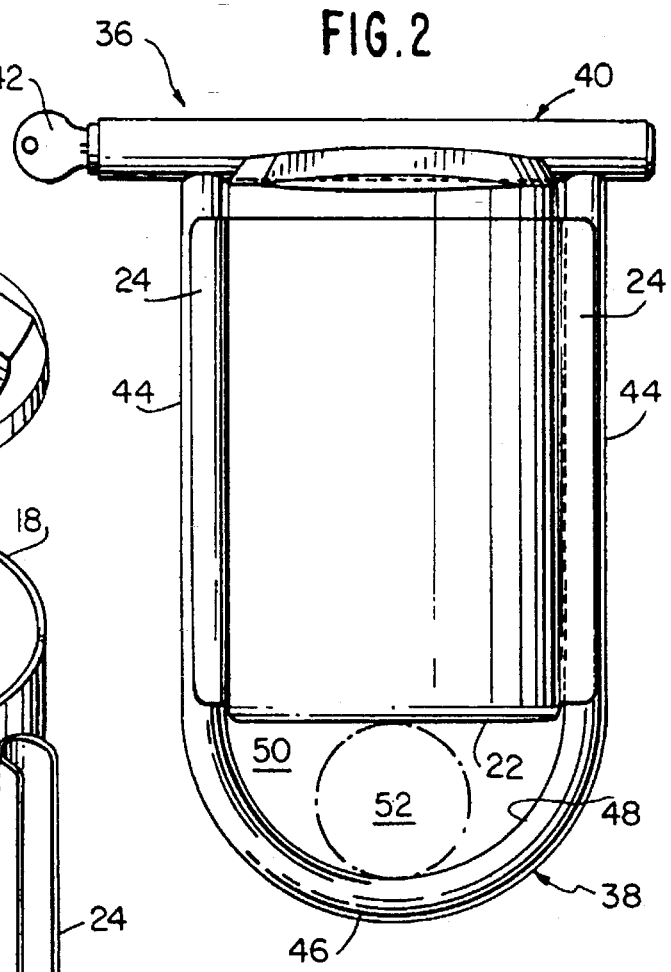
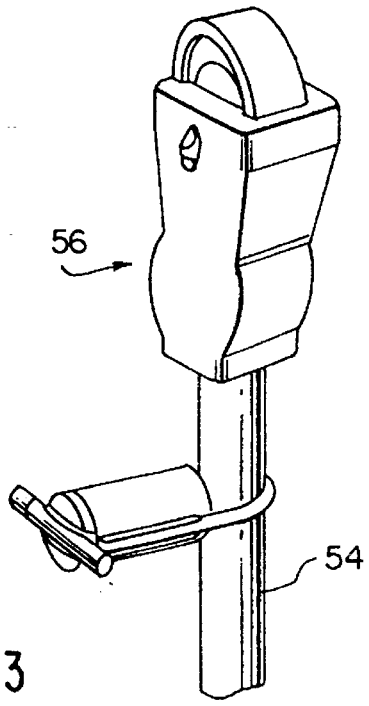
FIG.3

FIG.4
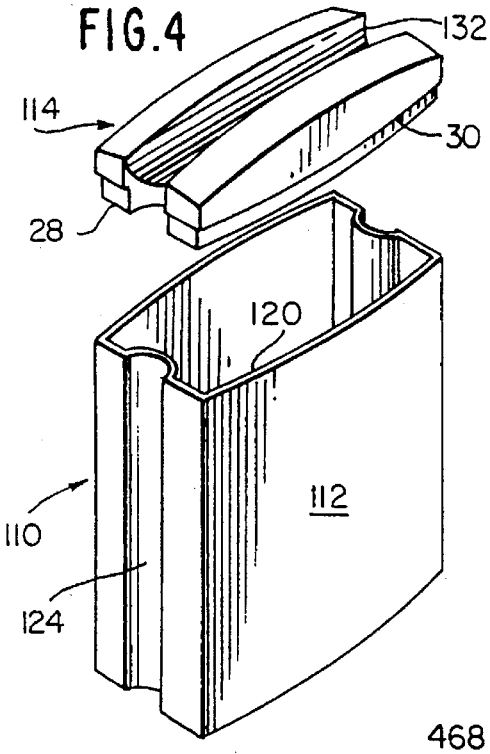
FIG.5
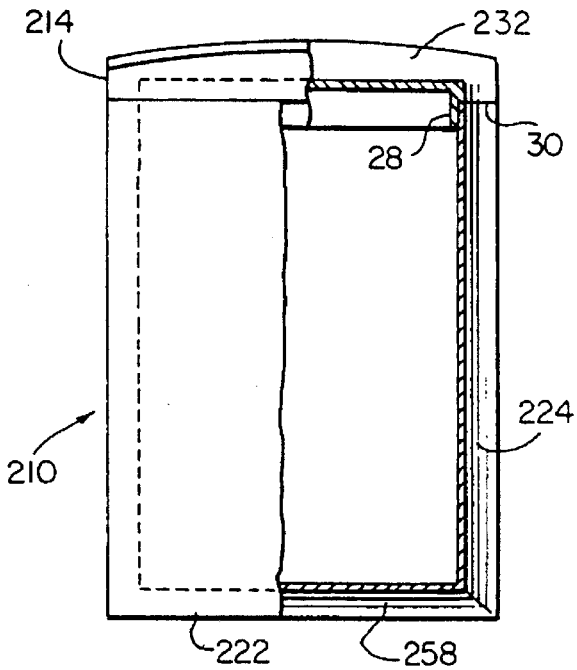
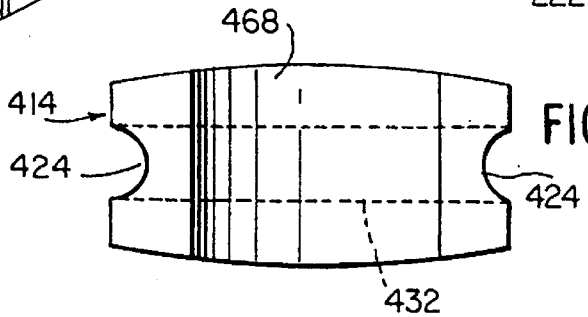
FIG.8
FIG.7
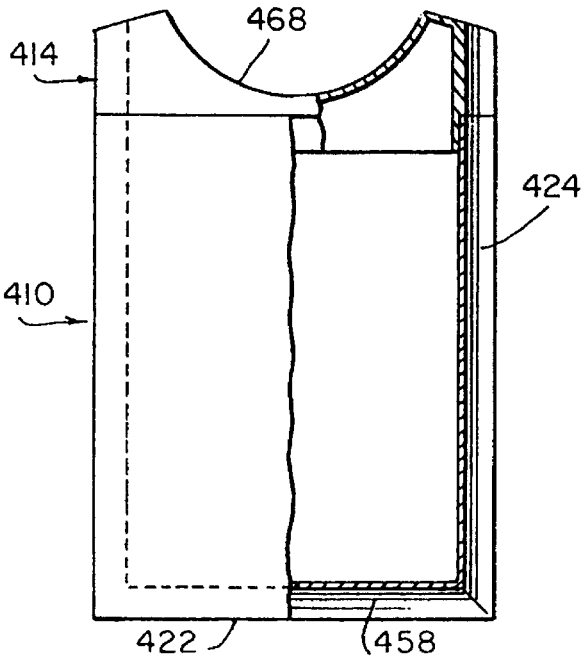
FIG.6
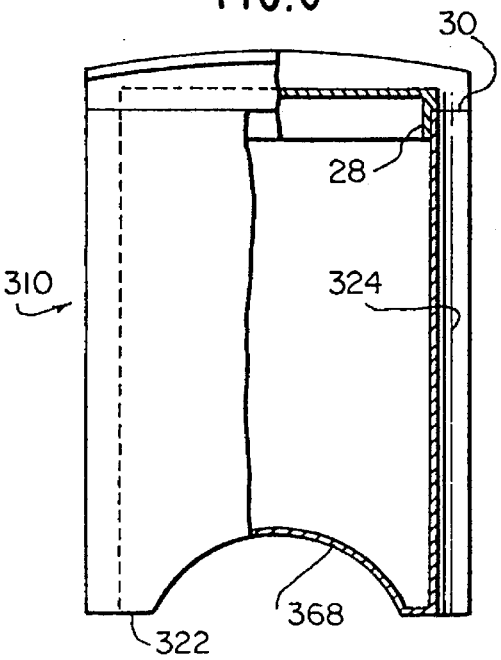

LOCKABLE CONTAINER

BACKGROUND OF THE INVENTION

1. Field of The Invention

This invention relates to a portable, lightweight, lockable container for cyclists, beach-goers, picnickers, hikers, and others desiring a secure container for small valuables, such as keys, wallets, jewelry, watches, cameras, etc.

2. Description of Related Art

People on the go frequently have a need to store personal valuables temporarily in a lockable container which is portable, lightweight, of simple construction, and easy to use. Cyclists, runners, rollerbladers, campers, hikers, and boaters often need a secure place to stuff their sweatshirts, warm-up clothes, sunglasses, wallet, keys, fishing gear, tools, spare parts, towels, cameras and film, or simply something to drink. The container must meet the requirements listed above in order to be practical.

It would also be desirable to be able to securely fasten such a container to permanent fixtures commonly found in recreational areas such as beaches, parks, gymnasiums, etc., which may not have lockers conveniently available, without having to carry extra equipment to be able to do so. The prior art known to applicant falls short in one or more respects of meeting the foregoing requirements.

Prior patents known to applicant include the following:

U.S. Pat. No. 596,998 to Hawkins et al. shows a bicycle canteen having grooved sides for receiving tubular frame members of the bicycle. The weight of the canteen and any liquids therein act to hold the canteen on the bicycle.

U.S. Pat. No. 4,079,872 to Halter shows a container locked by a strap and a padlock. The padlock also coacts with a chain as a bike lock. Grooves in container walls receive the arms of the strap to secure the container therein.

U.S. Pat. No. 4,256,322 to Otsuka et al. shows a combination bike lock and carrier for use on an autobicycle. The bike lock is a U-shaped structure with a locking bar for the open end. It is modified to adapt it to being a baggage carrier.

U.S. Pat. No. 4,260,084 to Warren, Jr. shows a specially constructed container having a groove which interfits with a locking frame to secure the container to a vehicle.

U.S. Pat. No. 4,387,835 to Gölzer shows a pair of containers each having a hinged lid held closed by two elastic straps. The containers can be locked to a bicycle by passing a bicycle lock chain around a fixed part of the bicycle and through handles formed on the container body and on the hinged lid.

OBJECTS AND SUMMARY OF THE INVENTION

It is an object of the invention to provide a lockable container which is economical to produce, simple to use, easy to transport, and capable of functioning as a portable locker.

The foregoing and other objects are met in accordance with the present invention which comprises a lockable container adapted for use with a known type of bicycle lock. The lock comprises a rigid U-shaped body having two parallel arms integrally joined together by a bight and a locking bar having a lock mechanism therein. The container comprises a body having a sidewall with the top end open and the bottom end closed. Channels adapted to receive therein the parallel arms of the U-shaped body are molded into or fixed on the sidewall. The cap of the container also has a channel therein for receiving the locking bar of the lock. The vertical thickness of the cap plus the linear height of the body is slightly smaller than the length of the parallel arms between the locking bar, when locked onto the arms, and the merger of the arms with the bight, such that when the cap closes the open end of the container body and the parallel arms and locking bar are received within their respective channels, the container cannot slide along the parallel arms, and the cap will be prevented from being removed from the body by the lock.

BRIEF DESCRIPTION OF THE DRAWINGS

The foregoing and other objects, aspects and features of the present invention will be more fully appreciated as the same becomes better understood when considered in connection with the detailed description of the present invention viewed in conjunction with the accompanying drawings, in which:

FIG. 1 is an expanded perspective view of a first embodiment of a lockable container in accordance with the present invention;

FIG. 2 shows the lockable container of FIG. 1 in combination with a known type of bicycle lock;

FIG. 3 shows one mode of using the embodiment shown in FIGS. 1–2;

FIG. 4 shows a perspective of a second embodiment of a lockable container of the present invention;

FIG. 5 is a partial cross-section of the embodiment of FIG. 4 with the lid in place on the body of the container;

FIG. 6 is a partial cross-section of a third embodiment of a lockable container of the present invention;

FIG. 7 is a partial cross-section of a fourth embodiment of a lockable container; and FIG. 8 is a top view of the embodiment of FIG. 7.

DETAILED DESCRIPTION OF THE PREFERRED EMBODIMENTS

A first embodiment of the invention is shown in FIGS. 1–3. A lockable container 10 comprises a cannister, or body, 12 and a removable cap 14. Cannister 12 has a hollow interior 16 bounded by an open top edge 18, a sidewall 20, shown as being round in cross-section but which could have any convenient cross-sectional shape, and a closed bottom 22. Extending along the axial length of sidewall 20 are a pair of U-shaped channels 24 which are fixedly located on the exterior of sidewall 20 on diametrically opposite sides thereof. Channels 24 are either formed integrally with cannister 12, or they may be fixedly attached thereto by any known means, such as by welding or by an adhesive, depending on the material of cannister 12. Channels 24 form outwardly facing, arcuate recesses 26.

Cap 14 preferably includes a downwardly facing flange 28 adjacent shoulder 30 (FIGS. 4–7). Flange 28 closely fits in hollow interior 16 with shoulder 30 resting on open top edge 18. Cap 14 closes container 10. A third, arcuate channel 32 is diametrically formed in the top surface 34 of cap 14.

Referring to FIG. 2, a conventional type of bicycle lock 36 is shown attached to lockable container 10. Lock 36, which is available on the market under the brand name KRYPTONITE®, is made of a rigid material, such as steel, and comprises a U-shaped body 38, a locking bar 40, and a key 42 shown inserted in a locking mechanism (not shown). U-shaped body 38 consists of two substantially parallel arms 44 joined together at their lower ends by integrally formed bight 46. The two parallel arms 44 of U-shaped body 38 each have a free end opposite to bight 46 which are each received in respective openings formed in locking bar 40. Locking bar 40 thus extends between parallel arms 44 and is removably attached thereto. Key 42 actuates a lock mechanism (not shown) located internally of locking bar 40 for locking and/or unlocking locking bar 40 in a known manner.

Container 10 is shown in FIGS. 2–3 securely locked within the confines of lock 36. The diameter of cannister 12 is slightly less than the distance between parallel arms 44 and channels 24 are shaped such that they snugly receive parallel arms 44 therein. In like manner, channel 32 in lid 14 snugly receives locking bar 40 therein. Finally, the length of sidewall 20 plus the height of cap 14 are selected such that when container 10 is placed within lock 36 in the orientation shown in FIG. 2, the bottom 22 of cannister 12 coincides substantially with the merger of arms 44 and bight 46. Because of the convergence of inner wall 48 of bight 46, lockable container 10 cannot move longitudinally of parallel arms 44 sufficiently for locking bar 40 to become free of channel 32 in cap 14. Cap 14 cannot then be removed from cannister 12, and the two are securely locked together by lock 36. Some tolerance is acceptable, but when lock 36 is in place, cap 14 must be incapable of being removed from cannister 12 sufficient to provide access into hollow interior 16. The length of flange 28 is selected to extend sufficiently into the hollow interior 16 of cannister 12 that normal manufacturing tolerances will not be enough to expose interior 16 to the outside.

The embodiment of the invention shown in FIGS. 1–3 is assembled as follows. Cannister 12 is placed within parallel arms 44 such that arms 44 are engaged within channels 24. Cap 14 is placed on cannister 12 such that flange 28 is located within hollow interior 16 and shoulder 30 rests on upper edge 18. Cap 14 is then rotated until the axis of channel 32 lies substantially in the plane of parallel arms 44. Locking bar 40 is placed on the upper ends of parallel arms 44, and thereby concurrently within channel 32, and is locked in place. At that point, lockable container 10 is securely locked, and any articles which have been placed therein are safe from loss or theft.

Bight 46 diverges from bottom 22 to form an open space 50. Bight 46, therefore, constitutes a handle by which lock 36 and container 10 may be carried. It should be noted that the overall combination of container 10 and lock 36 form a substantially rigid structure which is compact, lightweight, and easy to carry.

When it is desired to leave lockable container 10 behind temporarily while otherwise engaged, such as when a swimmer goes into the water at the beach or when a construction worker climbs the steel skeleton of a skyscraper under construction, open space 50 may be advantageously utilized. Any convenient permanent fixture 52, shown in phantom in FIG. 2, can be placed within space 50 so that container 10 and lock 36 are secured thereto. FIG. 3 illustrates an example wherein post 54 of parking meter 56 is placed in space 50 and container 10 is assembled within lock 36 as described above. The combination of lock and container cannot be removed from the scene, and valuables enclosed in lockable container 10 will be safe, even when left unattended.

The permanent fixture 52 of FIG. 2 and the parking meter post 54 of FIG. 3 are shown as having a circular cross-section. This is for illustration only. Either could as easily be oval, square, rectangular, or of any convenient cross-sectional shape. So long as the cross-sectional dimension fits within space 50, lockable container 10 can be affixed thereto.

In like manner, fixture 52 and post 54 are shown as having a diameter equal to the maximum vertical (as seen in FIG. 2) dimension of space 50. Fixture 52 could as easily be smaller than said maximum dimension. For instance, lock 36 could enclose the spokes, wheel and/or frame of a bicycle, a tree trunk or limb, links of a chain-link fence, a sign post, or links of a chain wrapped around a much larger structure. Lock 36 and lockable container 10 may hang from permanent fixture 52, but in all such cases, the container and lock form a secure, unopenable combination which cannot be removed from the area short of physically destroying the lock, container, or permanent fixture.

Thus, even though the lockable container is light weight and composed of only a few inter-locking pieces, it is both portable and can be securely fastened to any convenient existing structure while maintaining its integrity as a lockable container.

It should be noted that lock 36 is a bicycle lock in its own right. That is, when separated from container 10, it can be used independently as a bicycle lock. In like manner, container 10 is a container independent of lock 36. The two functions are combined when cyclists use the combination while cycling. If their bicycles are left behind while they proceed to another destination by another mode of transportation, the bicycle can be locked, and the container can be taken along with the cyclists. This dual utility is an important feature of the invention.

FIGS. 4–8 disclose other embodiments of the invention. Similar reference numerals, incremented by 100, 200, etc., designate similar features.

In FIG. 4, lockable container 110, consisting of cannister 112 and cap 114, is given a more rectangular cross-section. Channels 124 are formed in sidewall 120 as an integral part of cannister 112. Cannister 112 is dimensioned such that parallel arms 44 of lock 36 are snugly engaged within channels 124. As in the embodiment of FIGS. 1–3, channel 132 in lid 114 is adapted to receive locking bar 40 therein. The combination is assembled as in the first embodiment.

In FIG. 5, channel 258 is integrally formed in bottom 222. Channel 258 extends across bottom 222 and mates with channels 224. Channels 258 and 232 provide the convenience of being able to orient lockable container 210 within lock 36 with lid 214 facing either locking bar 40 or bight 46. This can be useful. For instance, when locking bar 40 is received in channel 258, and bight 46 is being used as a handle, cap 214 will be in the upright position, and cannister 210 can then carry liquids without spilling. In either orientation, lockable container 10 will be securely closed.

Referring to FIG. 6, an arcuate indentation 368 is provided in bottom 322 of container 310. Indentation 368 provides an enlarged space between bight 46 and bottom 322. Lockable container 310 thus fits better with a round post (e.g., post 54 of FIGS. 3), and can also be attached to larger permanent fixtures. The larger open space of FIG. 6 allows a plurality of disparate objects to be enclosed between lock 36 and container 310. One of the features of the invention is that lock 36 has a dual role in the use of the invention, i.e., it can be used as a bicycle lock when separated from the cannister as well as the locking means of the cannister when joined therewith. In addition, the design of cannister 310 of FIG. 6 promotes the simultaneous use of lock 36 as a bicycle lock and as a lock for the cannister.

Indentation 368 can be made large enough that space 50 is capable of enclosing a bicycle tire, frame, and/or a convenient permanent fixture, while cannister 310 is locked within the confines of lock 36. Thus, when it is necessary for the cyclist to leave the bicycle for a time, both the bicycle and container 310 can be securely locked.

FIGS. 7 and 8 show a variation of cannister 310 in that indentation 468 is formed in cap 414 of cannister 410.

It is within the scope of the invention to make both cap and cannister of various known materials and by various known methods. For example, they can be extruded, pultruded, or molded from known plastics and composite materials. They can also be formed of sheet metal, of a single or plural parts, and pressed or welded together.

Other obvious variations will occur to one skilled in the art in view of the teachings of the invention. For instance, when the cannister and cap are made of a moldable plastic, they may be joined by an integral, flexible hinge, thereby reducing the number of separate parts involved, and aiding in the prevention of loss of the cap.

It can be seen from the above that an invention has been disclosed which fulfills all the objects of the invention. Obviously, numerous modifications and variations of the present invention are possible in light of the above teachings. It is therefore to be understood that within the scope of the appended claims, the invention may be practiced otherwise than as specifically described herein.

I claim as my invention:

1. In combination, a lock and a lockable container, said combination comprising:

said lock comprising:

a rigid U-shaped body having two linear, substantially parallel arms integrally joined together at one end by an arcuate bight, and a linear, rigid locking bar having a lock mechanism therein, said locking bar, when locked onto the other end of said parallel arms, closing the open end of said U-shaped body;

said lockable container comprising:

body means for defining a cannister-type body, said body means including a sidewall, an open end, and a closed end;

said sidewall including first channel means for receiving said parallel arms; and cap means for selectively opening and closing said open end of said body means, said body means including second channel means for receiving said locking bar, whereby when said first and second channel means have said parallel arms and said locking bar therein, respectively, and said locking bar is locked onto said U-shaped body, said lockable container is held closed and locked by said lock.

* * * * *